US009445658B2

(12) United States Patent
Murphy

(10) Patent No.: US 9,445,658 B2
(45) Date of Patent: Sep. 20, 2016

(54) CLIP TO EASILY APPLY AND ADJUST SIZES OF BARBER CAPES

(71) Applicant: Robert Murphy, Jackson, TN (US)

(72) Inventor: Robert Murphy, Jackson, TN (US)

( * ) Notice: Subject to any disclaimer, the term of this patent is extended or adjusted under 35 U.S.C. 154(b) by 244 days.

(21) Appl. No.: 14/070,083

(22) Filed: Nov. 1, 2013

(65) Prior Publication Data

US 2015/0121601 A1 May 7, 2015

(51) Int. Cl.

| | |
|---|---|
| ***A45D 44/08*** | (2006.01) |
| ***A44B 99/00*** | (2010.01) |
| ***A41F 1/00*** | (2006.01) |
| ***A41D 3/08*** | (2006.01) |

(52) U.S. Cl.

CPC ..... *A45D 44/08* (2013.01); *A41D 3/08* (2013.01); *A41F 1/00* (2013.01); *A41F 1/002* (2013.01); *A44B 99/00* (2013.01); *A44D 2203/00* (2013.01); *Y10T 24/44385* (2015.01)

(58) Field of Classification Search

CPC .... A41D 13/04; A41D 13/0512; A41D 3/08; A45D 44/08; A41F 1/00; A41B 3/16; A45F 5/02

USPC ..... 2/48, 50, 52, 468, 96, 88, 135; 24/3.11, 24/3.12

See application file for complete search history.

(56) References Cited

U.S. PATENT DOCUMENTS

| | | | | | |
|---|---|---|---|---|---|
| 1,567,433 | A * | 12/1925 | Favata, Jr. | A45D 44/08 | 24/331 |
| 2,969,548 | A * | 1/1961 | Herschensohn | A45D 44/08 | 2/50 |
| 5,852,849 | A * | 12/1998 | Lansing | A45D 44/08 | 24/298 |
| 5,933,922 | A * | 8/1999 | Ochsman | A45F 5/02 | 24/3.11 |
| 5,953,753 | A * | 9/1999 | Perez | A45D 44/08 | 2/48 |
| 5,956,812 | A * | 9/1999 | Moennig | A45F 5/02 | 24/3.13 |
| 6,754,937 | B1 * | 6/2004 | Martin | B42F 1/006 | 24/351 |
| 7,461,662 | B2 * | 12/2008 | Kim | A45D 8/20 | 132/276 |
| 7,850,302 | B1 * | 12/2010 | Riazi | A45F 5/02 | 24/3.3 |
| 8,800,941 | B2 * | 8/2014 | Kahn | A46B 17/02 | 248/110 |

* cited by examiner

*Primary Examiner* — Tejash Patel

(57) ABSTRACT

A clip device that allows for easy application of barber capes around a wearer with a reliable connection that facilitates adjustment for a suitable fit is provided. Such a device includes a spring-loaded lift structure that closes around a placed cape portion at any used length with grip means to prevent cape slippage during a haircut operation. The clip itself is configured with a flat back for suitable placement in alignment with the base cape portion and may be removed, if desired, for cleaning or other like actions. As well, the clip includes an extended front including the aforementioned lift structure further including a curved lip to facilitate the disengagement between clip and cape portion on demand, but with a form that is not susceptible to undesired detachment through accidental contact therewith. The clip alone, as well as an incorporating cape, are encompassed within this invention.

20 Claims, 4 Drawing Sheets

CLIP TO EASILY APPLY AND ADJUST SIZES OF BARBER CAPES

FIELD OF THE INVENTION

The present invention relates to a clip device that allows for easy application of barber capes around a wearer with a reliable connection that facilitates adjustment for a suitable fit. Such a device includes a spring-loaded lift structure that closes around a placed cape portion at any used length with grip means to prevent cape slippage during a haircut operation. The clip itself is configured with a flat back for suitable placement in alignment with the base cape portion and may be removed, if desired, for cleaning or other like actions. As well, the clip includes an extended front including the aforementioned lift structure further including a curved lip to facilitate the disengagement between clip and cape portion on demand, but with a form that is not susceptible to undesired detachment through accidental contact therewith. The clip alone, as well as an incorporating cape, are encompassed within this invention.

BACKGROUND OF THE INVENTION

It is customary for patrons of barber shops, beauty parlors, etc., to wear capes while getting a haircut (of any type). Such an article prevents the vast majority of cut hair from landing on and adhering to a patron's own clothing, thereby allowing such unwanted hair residue to primarily land on the shop floor instead. Additionally, such a cape allows for the application of water, hairspray, pomade, hair dye, and other types of liquids to the patron's hair before, during, and after a haircutting activity. Furthermore, patrons seeking perms and other like treatments, without the necessity of a haircut, utilize such cape articles to protect his or her clothing in a like manner. Basically, such capes are mainstays within the hair treatment industry.

Although these articles have been utilized for many years, there are distinct problems with those found in typical barber and beauty (or both) establishments. For the most part, the fact that not all patrons are of the same size creates an initial issue in that there are few capes that provide a suitable one-size-fits-all configuration. As such, there exists a need to provide capes that include modification possibilities to allow for such patron size and build differences. These possibilities, however, are very limited to, for example, the presence, on one top end of a sample cape, of multiple snaps or buttons (with a single receiver or buttonhole on the opposite top end) in staggered distances from one another along the same top end. Such a format thus allows, to a certain extent, the ability to wrap a cape around a patron and connect the ends together at a point for which possible suitable coverage (and hoped-for comfort) are accorded the wearer. Unfortunately, without a very high number of such snaps in place, the ability to provide a complete, snug cover around every potential patron is impossible. With some patrons, there will remain gaps in the cape top periphery, or the cape may actual slip in one direction until it catches on one side of the wearer's neck. In essence, such a snap or button configuration, though prevalent in today's hair treatment shops, exhibit significant deficiencies, particularly if liquids are applied to a subject's hair while a loosely placed cape is utilized.

There have been some attempts to correct for these drawbacks. For instance, one typical measure undertaken is the jury-rigging of a cape with a temporarily placed hair clip around a bunched portion of such a draped cape article. Such a procedure, however, has proven highly suspect and undesirable, primarily due to the potential of nicking the patron with the teeth portions of the clip during application to the cape, as well as the ease with which such a clip can be dislodged from its position through typical haircutting movements. The need to avoid any contact with such a suspect device requires further concentration on that aspect of a haircut or other exercise, rather than on the patron's hair alone. As well, the utilization of such an exterior clip device does not function well in relation to dye, perm, or other like liquid applications.

Other possible improvements have included the utilization of magnets (instead of snaps) to provide a snug fit of a subject cape around a patron's shoulders and neck, at least. However, such a structure exhibits its own problems in that such complete drape coverage requires an external application of two attracting magnets on either end of a subject cape. As with the snaps noted above, the lack of magnets placed along a line and ostensibly in contact with each other leaves the potential for gaps in drape coverage during use. Additionally, the ease of actual disengagement of such magnets from one another during a haircut or other treatment activity militates away from undertaking such potentially suspect connections, too.

Otherwise, the prior art shows very little in the way of suitable and reliable cape coverage facilitators in this respect. There are certain suggestions as to having slotted cardboard or plastic devices placed over the top edges of opposing cape ends during utilization that allow for both ends to slide through until reaching a certain point of complete cape coverage. A hold then retains both ends until removed. Unfortunately, such hold operations are similarly limited in reliability to magnets and snaps in that such a device relies upon a limited amount of actual contact by a barber, hairdresser, etc., during a hair treatment activity. Any bump, brush, or other type of typical movement and contact with such a hold could lead to disengagement and thus loss of the draped article at its needed disposition around the patron.

Thus, it is evident that there exists a significant need to overcome these deficiencies with a means to provide not only suitable connection between cape ends, but also in a manner that provides a reliable attachment that will not release until activated by the barber, hairdresser, etc. Additionally, such a means of connection should not exhibit any propensity to contact (and thus potentially irritate or scratch) the wearer's skin during operation, as well as a simple and easily actuated disengagement component to permit detachment on demand and the ability to adjust the cape opening to any degree. To date, other than the structures and alternative configurations noted above, the hair treatment industry is lacking such a beneficial cape end attachment device.

ADVANTAGES AND SUMMARY OF THE INVENTION

It is an advantage of the present invention to provide a reliable barber cape clip connector that does not contact with a wearer's skin during use and also accords the ability to adjust the coverage thereof on demand to any degree needed. Another advantage of this inventive clip is the ability to disengagement the connection over a cape end through contact and manipulation of a suitably curved lip, thereby permitting such action with a single hand (or even finger). It is an additional advantage that the inventive clip structure provides for reliable temporary connection to a cape end so as to allow removal for cape cleaning, if desired. Yet another advantage of this invention is the reliability of the contact and connection of clip teeth of rear and front components to retain a captured cape end therein without loss of retention integrity due to common haircutting, etc., activities.

Accordingly, the present invention encompasses a clip device having a flat rear clip portion and a curved front clip portion; wherein said rear clip portion has a top end and a bottom end and also has a first side and a second side, each sharing a first side edge and a second side edge, said second side including a plurality of extended teeth disposed between said first side edge and said second side edge; wherein said curved front clip portion has a top end and a bottom end and also has a first side and a second side, each sharing a first side edge and a second side edge, wherein said curved front clip portion is substantially parallel to said top end of said rear clip portion and said bottom end exhibits a curved edge that extends away from said flat rear portion; wherein said rear and front clip portions share a single rod connection component and at least one spring in contact with both of said rear and front clip portions; wherein said spring is configured to allow for at least a portion said first side of said front clip portion to be in contact with a portion of said extended teeth of said second side of said rear clip portion in idle state and allows for the curved edge of said front clip portion to be moved away from said rear clip portion to provide an open space therebetween when said front clip portion is manipulated with force in such a direction.

Additionally, encompassed within this invention is the clip outlined above wherein said second side of said rear clip portion includes two solid extensions situated substantially perpendicularly to said second flat side, wherein said extensions have top edges that are even with the edge of said rear clip portion top end and bottom edges disposed at a point below said top edge, wherein said extensions include openings therein to permit the simultaneous introduction of said single rod connection component therein, and wherein said plurality of extended teeth are located below said bottom edge of said solid extensions; wherein said first side of said front clip portion includes two solid extensions situated substantially perpendicularly to said first side, wherein said extensions have top edges that are even with the edge of said front portion top end and bottom edges disposed at a point below said top edge, wherein said extensions include openings therein to permit the simultaneous introduction of said single rod connection component therein; wherein said openings within said solid extensions of said rear clip portion and said front clip portion are aligned such that said single rod connection component is introduced simultaneously within all four openings; and wherein said at least one spring device is in contact with said single rod connection component and with both said rear clip portion and said front clip portion simultaneously. The clip further comprising a cap portion over said single rod and said spring is also encompassed herein, as well as a configuration wherein said front portion includes extended teeth present thereon and aligned in nesting relation to said extended teeth present on said rear portion.

Thus, in addition to the clip itself, encompassed herein is a cape comprising the clip as described above, wherein said cape is flat, has at least one corner edge, and has a first side and a second side, and wherein said second side of said flat clip portion is in full contact with and attached to at one of said first side or said second side of said cape, particularly, in one embodiment at such a corner thereof one of the cape sides.

Such a clip thus allows for a tight grip between the curvature of the front portion and the extended teeth of the rear portion (and an increase in such pressure when the aforementioned curvature extended teeth are present) when applied to the end of a barber (or other like) cape. The curvature of the front portion provides a suitable manner of lifting the front portion away from the rear portion, as well, particularly through a single hand or finger maneuver. Such a benefit is important as typical snap configurations require two hands for disengagement. As well, the reliable spring utilization in this manner applies sufficient pressure to retain such a cape end at a selected position for comfort and proper coverage for the patron. Such a clip configuration thus not only allows for flat placement on the outer side of a cape, and at a cape top end, for that matter, without contacting the skin of the patron during utilization, but also the ability to adjust the length of the cape draped around such a patron to any degree for comfort and coverage purposes. In essence, without the need for snaps, buttons, magnets, holds, etc., that are provided at specific locations on a cape top edge, this inventive clip actually allows for movement of a cape top end to any location on demand, as well as disengagement on demand, thus providing an actual one-size-applies-to-all barber cape article.

The two sets of solid extensions on the rear and front portions of the clip device permit a resilient base for the single rod to be introduced and retained. The rod provides a suitable axis for the spring to be applied as well as a means for the slight needed movement of the front portion (or, in actuality, the rear portion, as such a spring allows either or both portions to move; when applied, however, to a cape and placed on a patron for a haircutting, etc., activity, the front portion would be the most likely of the two to be manipulated for disengagement purposes) for application and/or disengagement. The presence of two solid extensions thus increases the strength of the clip in the rod retention area to ensure stability of the entire device so the spring will reliably operate as needed.

The extended teeth of either the rear portion alone or present on both the rear and front portions provide suitable grip to the target cape end when introduced therein and when the front portion is released to its idle state (that is, when the clip is allowed to close through operation of the spring to such a position; to release the grip of the extended teeth from the target cape end, the front portion must be manipulated away from the rear portion extended teeth, thereby rendering the spring in an activated state awaiting release back to a closed, idle position).

The curvature of the front portion may be of any suitable arc measurement to allow for at least some contact between one part of such a curved structure and the extended teeth of the rear portion. Without such contact, the ability of the clip to retain the target cape end would be compromised and largely ineffective, most likely. As such, such a curve may be from a 5° angular measurement from the bottom edge of the front portion solid extensions to the bottom edge of the front portion, up to 180° (in essence, a half-circle). Preferably, such a curvature reflects a measurement from 20 to 75° for such a purpose.

The single rod is preferably a cylindrical structure having a length slightly longer than the length of the distance between the solid extensions of both rear and front portions of the clip (to allow for introduction and extension through the openings thereof). Such a rod may be of any geometric configuration as long as it permits proper spring contact and operation and such solid extension opening introductions (and retention therein). The spring may actually be more than one such component of the clip, although a single spring is potentially preferred simply from a cost and complexity standpoint. Such a spring is a typical wound structure of a single metal wire with extended end for placement at resilient solid portions of both the front and rear portions to permit continuous and consistent operative capability to rest and to return the clip to its idle state when pressure is applied opposite to that related to the spring strength.

A cover, as noted above, may also be included to protect the rod and spring from external exposure (as well as possibly protect the user from potentially injuring her- or him-self by introducing a finger within such a cavity in the clip). Such a cover may be integrated into the rear and/or front portion, or may be separately provided and attached in such a manner, as well.

The materials utilized within the clip are preferably metallic in nature, such as aluminum, steel, brass, and the like, and, in particular, the spring should be of a suitable size and gauge to fit within the clip device and apply the needed pressures for activation to occur. Thus, a suitable steel or aluminum wire spring of a XX gauge and wound from 3 to 7 times, preferably 5, and having a round diameter of from 0.8 to 1.4 centimeters, preferably about 1-1.2 cm, is potentially preferred for this purpose. The rod component is preferably aluminum or steel in constitution, having an end diameter of from 3 to 8 millimeters, and a length of from about 3 to 7 centimeters. The rear and front portions may be made from metal or polymer materials themselves, preferably aluminum (for cost and strength purposes), although polyacrylate, polyolefin, and polyurethane materials may be utilized for these portions as well. The solid extensions have openings that will conform to the size of the single rod (and thus large enough to allow for introduction thereof) and are disposed at a distance conforming to that of the single rod, too. The extended teeth of the rear and possibly front portion are of metal or polymeric constitution as alluded to above, as well. Preferably, such teeth are separately produced and connected to the subject portion surface (either through connectors, such as screws, bolts, and the like, or by gluing, soldering, or welding). The alternative top cover may be of the same metal or plastic material, or different from the materials utilized for the rear and front portions (as well, the rear portion and front portion may be of different materials, such as different metals, one a metal and the other a plastic, or different plastics, if so desired). The actual implementation of the single rod through the solid extensions of the rear and front portions, as well as the presence and utilization of the spring component in association therewith, provides the necessary connection between the rear and front portions for actual construction and structural stability of the clip. Thus, even though other connection means and/or applications may be employed for clip manufacture, such may not be needed for the overall clip structure to be viable for utilization as intended.

Thus, for actual use of the inventive clip, such may be attached to the top end of one edge of a cape article with the rear portion adhered, attached, or otherwise reliably and resiliently contacted therewith such a cape region. The top edge of the clip device (i.e., top edges of the rear and front portions) should be substantially aligned with and parallel to the top edge of the target cape for best results (i.e., best alignment of the other cape end upon draping and connection). Although such a result is preferred, in actuality, the clip may be attached at a level lower than the cape top edge, such as up to 9 inches below such an edge. Again, the closer to such a top cape edge the better. As well, such cape edge attachment is preferably at the edge of the cape end side, too, for best results. Of course, the user may have this adjusted to be a certain distance away from such a cape side edge if desired without deleteriously effecting the overall capability of the clip to function properly. A distance of up to 9 inches in this manner may thus be acceptable, though, again, the closer to the side edge of the cape, the better. Such clip attachment to the cape may be through screws, bolts, particularly with grommets in place to protect the structural integrity of the cape itself, or through an adhesive or even hook and loop system (with a hook structure applied to either the cape or the first side of the rear portion of the clip and a loop structure on the other), as examples. With a screw or bolt alternative, the clip may be considered permanently applied to the cape (and thus difficult to remove). An adhesive or hook and loop possibility allows for removal for cleaning purposes, certainly.

Thus, the cape end not attached to the clip may be introduced therein after draping around a patron. Once the free end is thus brought around a subject patron, and thus with the clip cape end situated behind the subject patron, the front portion of the clip may be lifted away from the rear portion (or the rear portion manipulated away from the front portion) and a portion of the free cape end may be introduced between the rear and front portion of the clip. The barber (or hairdresser, and the like) may be move the free cape end to a suitable position to allow for full patron coverage (as needed) and simultaneous comfort. Once that is decided, the barber can then release the front (or rear) portion of the clip and the selected free cape end portion present between the two clip portion is then secured in place through the engagement of the curvature of the front portion and the extended teeth of the rear portion (or, again, between two sets of extended teeth on both portions). On demand, then, the barber may disengage the two portions and thus the free cape end by lifting the front portion (or the rear portion, again).

In this manner, the patron is not affected by the operation of the clip (no contact, nicking, pinching, etc., for example) and the barber (or like person) may properly drape and apply the cape over the patron for maximum comfort and coverage. Additionally, due to the resiliency of the spring-loaded clip device and the integrity of the extended teeth thereof, the device will not release the secured free cape end until actual manipulation is undertaken by the barber (hairdresser, and the like). The curvature of the front portion thus allows for facilitation of such an action as it is disposed in a manner that allows easy reach and activation by the barber. With a flat front portion, the barber would have difficulty in separating the two portions of the clip, basically.

DETAILED DESCRIPTION OF THE DRAWINGS AND PREFERRED EMBODIMENTS OF THE INVENTION

Hereinafter, preferred embodiments of the present invention will now be described with reference to the accompanying drawing. Such descriptions are not intended to limit the scope of the overall invention but only to provide one potential embodiment thereof.

Figure 1:
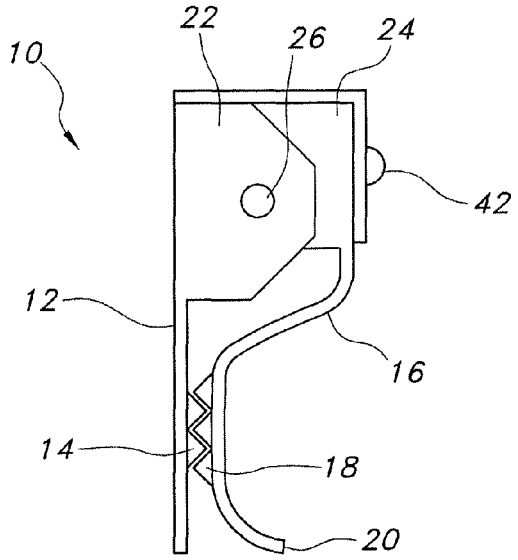
FIG. 1 depicts a cross-sectional side view of one potentially preferred embodiment of an inventive clip.
Figure 2:
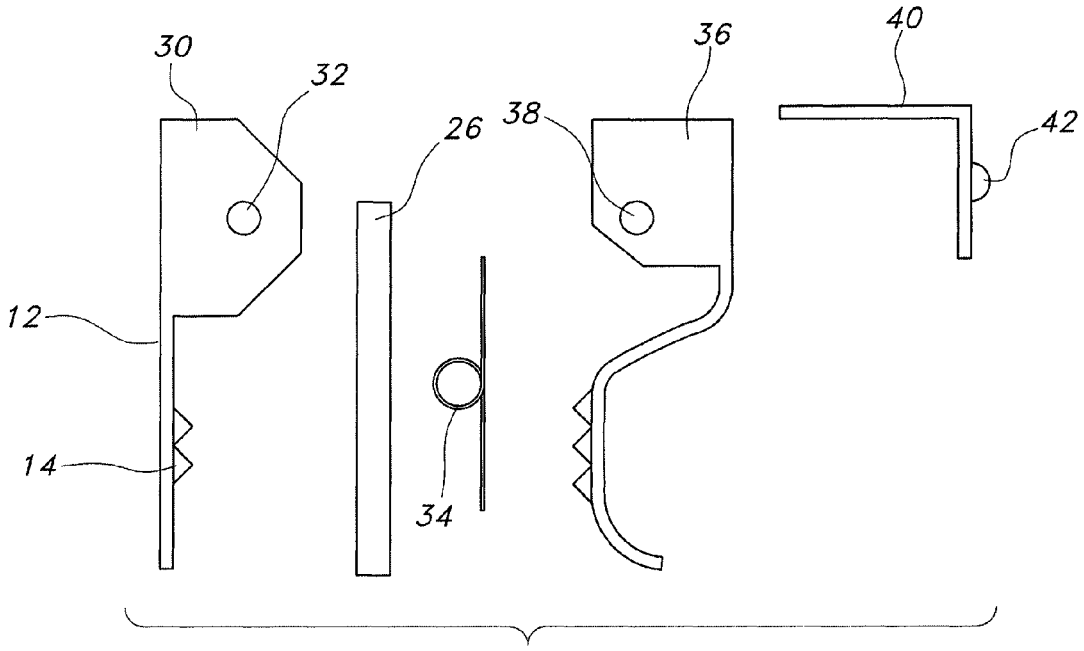
FIG. 2 depicts a blown-up view of the components of the embodiment in FIG. 1.

As shown in FIGS. 1 and 2, a clip device 10 is provided including a flat rear portion 12 including extended teeth 14 and a top edge 22 including solid extensions (30 of FIG. 2) and openings (32 of FIG. 2) for a rod (26 of FIG. 2) to be introduced. The clip device 10 further includes a front portion 16 having a top edge 24, a curved lip 20, and, in this embodiment, extended teeth 18 (again, such teeth are not required, but may be included for increased grip pressure). Such extended teeth 18 are disposed in such a manner as to nesting between the extended teeth 14 of said rear portion 12. The front portion 16 includes solid extensions (36 of FIG. 2) with openings (38 of FIG. 2) for the same rod (26 of FIG. 2) to be introduced as for the rear portion 14. The device 10 further includes a wound spring 34 through which the rod 26 is also introduced. As well, the device 10 includes, though not required, but provided in this embodiment, a cover 40 to protect the rod 26 and spring 34. The cover 40 includes connectors 42 (such as screws, for example) to attach to the front portion 16 in this instance.

Figure 3:
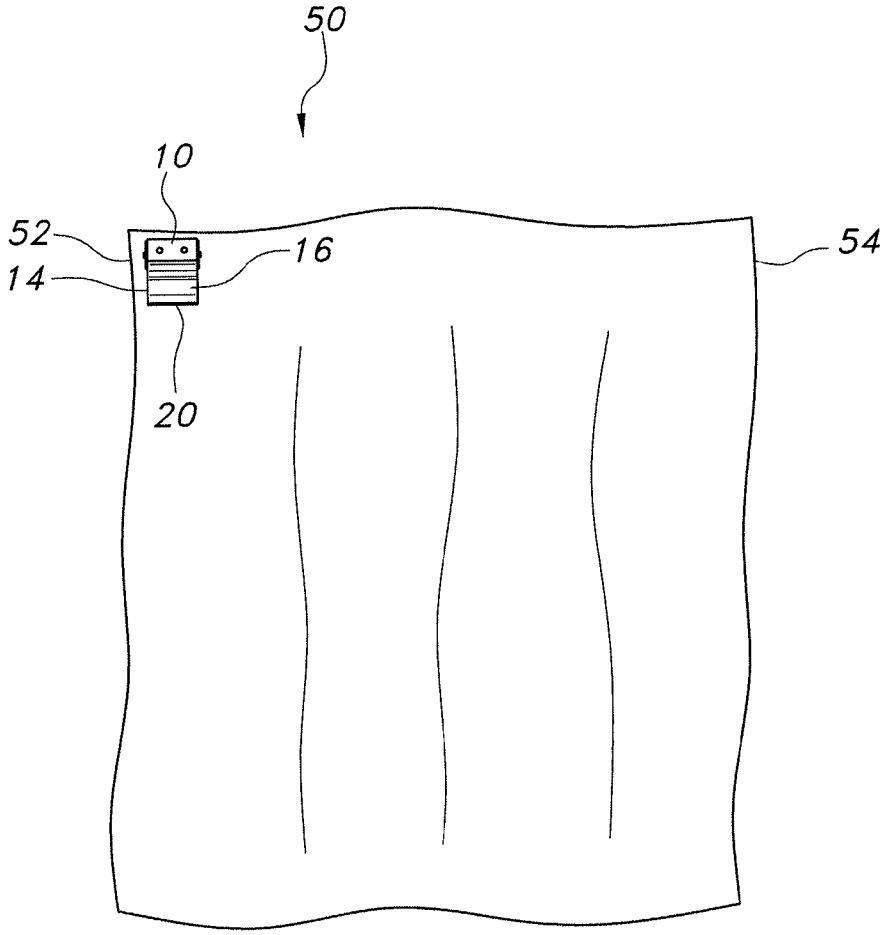
FIG. 3 shows a cape including the clip of FIG. 1.

FIG. 3 shows a cape 50 including the clip 10 and showing its rear portion 14 attached to the cape 50 and the front portion 16 on top with the curved lip 16 present for access to manipulation the device 10. The cape 50 has a clip end 52 and a free end 54, with, as the description implies, the clip 10 attached near the top and side edges of the clip 52 thereof (thus, present at a corner edge, in this instance, a top corner edge of the cape 50).

Figure 4:
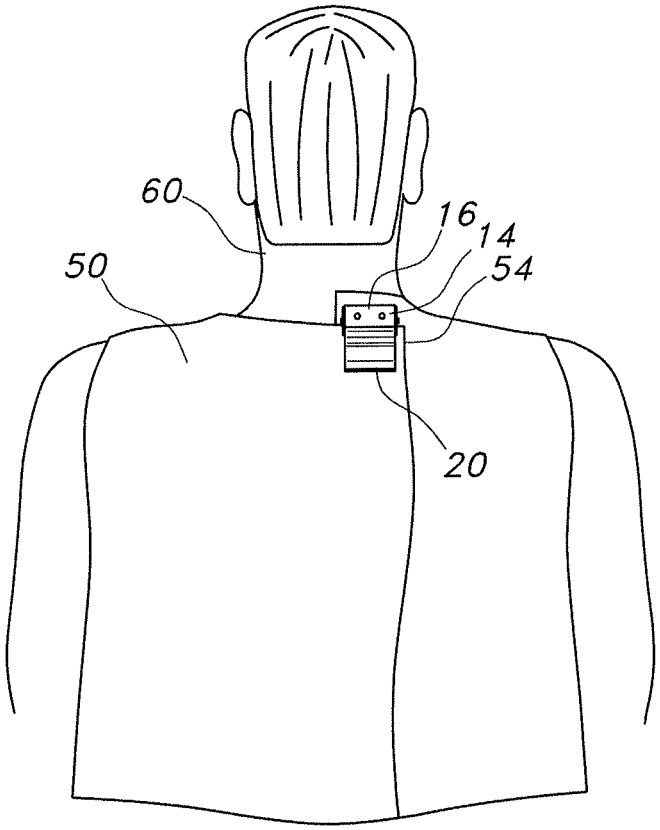
FIG. 4 shows the cape of FIG. 3 draped around a patron and with its ends attached with the clip.
Figure 5:
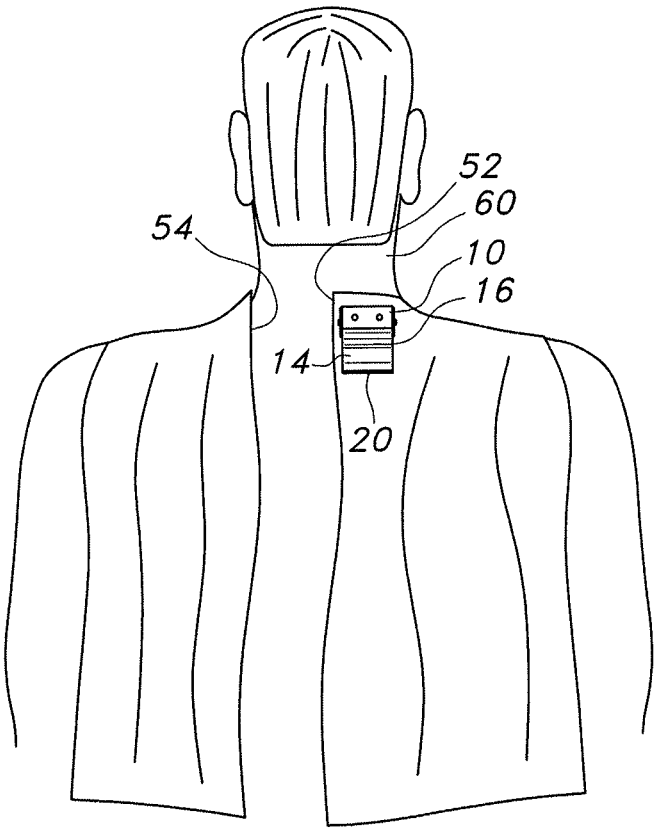
FIG. 5 shows the utilization of the cape of FIG. 4 with the clip detachment component lifted.

FIGS. 4 and 5 thus show the utilization of the clip 10 in relation to the cape 50 and a patron 60. The clip 10, being attached to the clip end (52 of FIG. 3) thus allows for the free cape end 54 to drape around the patron 60 and through the area between the rear portion (14 of FIG. 3) and the front portion 16 upon lifting of the curved lip 20. Thus, the free cape end 54 may be brought to any point around the patron 60 and through the clip device 10 as needed for suitable coverage and comfort for the patron 60. FIG. 5 shows the disengagement of the clip device 10 with the free cape end 54 released from between the rear portion 14 and the front portion 16 through lifting of the curved lip 20.

Ultimately, the described clip device allows for greater efficiencies in utilization and, for that matter, availability of suitable hair treatment capes within a hair treatment establishment. With this device, truly one size of cape can be used for any size patron without the possible injury or discomfort to such a patron (such as through a jury-rigged hair clip operation for cape end connection purposes, as one example). Additionally, the activation of the clip is reduced to a simple and limited movement of a curved lip structure for ergonomic and efficiency purposes, and the actual engagement of the rear and front portions of such a clip device reliably and consistently retain a free cape end such that typical haircutting/hair treatment activities will not result in undesired disengagement thereof. Such a device provides unexpectedly good and effective results on multiple levels.

The preceding examples are set forth to illustrate the principles of the invention, and specific embodiments of operation of the invention. The examples are not intended to limit the scope of the method. Additional embodiments and advantages within the scope of the claimed invention will be apparent to one of ordinary skill in the art.

The invention claimed is:

1. A clip device having a flat rear clip portion, a connecting rod, a spring, and a curved front clip portion;

wherein said rear clip portion has a top end and a bottom end and also has a flat first side and a second side, each sharing a first side edge and a second side edge, said second side having a surface from which a plurality of teeth extend, said second side also having two solid extensions situated substantially perpendicularly to said flat first side and positioned with their top ends the same as said rear clip portion top end, said two solid extensions having opposing side edges, and said solid extensions including parallel openings within said opposing side edges;

wherein said curved front clip portion has a top end and a bottom end and also has a first side and a second side, said second side upper portion having two solid extensions situated substantially perpendicularly to said first side and positioned with their top ends the same as said front clip portion top end, said two solid extensions having opposing side edges, and said solid extensions including parallel openings within said opposing side edges;

wherein said connecting rod is situated simultaneously through the openings within said rear clip portion solid extension openings and said front clip portion solid extension openings, and wherein said at least one spring is in simultaneous contact with said rear clip portion solid extension and said front clip portion solid extension;

wherein said spring is in simultaneous contact with said connecting rod and both said front clip and rear clip portions, and wherein said spring is configured to force contact between said front clip portion and said plurality of teeth extending from said surface of said second side of said rear clip portion in idle state and allows for the curved edge of said front clip portion to be moved away from said rear clip portion to provide an open space therebetween when said front clip portion is manipulated with force in such a direction.

2. The clip of claim 1 wherein said rear clip portion solid extensions have top edges that are even with the edge of said rear clip portion top end and bottom edges disposed at a point below said top edge, and wherein said plurality of extended teeth are located below said bottom edge of said solid extensions;

wherein said front clip portion solid extensions have top edges that are even with the edge of said front portion top end and bottom edges disposed at a point below said top edge.

3. The clip of claim 1 further comprising a cap portion over said connecting rod and said spring.

4. The clip of claim 2 further comprising a cap portion over said connecting rod and said spring.

5. The clip of claim 1 wherein said front portion includes a plurality of extended teeth present thereon and aligned in nesting relation to said plurality of extended teeth present on said rear portion.

6. The clip of claim 2 wherein said front portion includes a plurality of extended teeth present thereon and aligned in nesting relation to said plurality of extended teeth present on said rear portion.

7. The clip of claim 3 wherein said front portion includes a plurality of extended teeth present thereon and aligned in nesting relation to said plurality of extended teeth present on said rear portion.

8. The clip of claim 4 wherein said front portion includes a plurality of extended teeth present thereon and aligned in nesting relation to said plurality of extended teeth present on said rear portion.

9. A cape comprising the clip as described in claim 1, wherein said cape is flat, has at least one corner edge, and has a first side and a second side, and wherein said second side of said flat clip portion is in full contact with and attached to at one of said first side or said second side of said cape.

10. The cape of claim 9 wherein said clip is present at least one corner edge thereof.

11. A cape comprising the clip as described in claim 2, wherein said cape is flat, has at least one corner edge, and has a first side and a second side, and wherein said second side of said flat clip portion is in full contact with and attached to at one of said first side or said second side of said cape.

12. The cape of claim 11 wherein said clip is present at one corner edge thereof.

13. A cape comprising the clip as described in claim 3, wherein said cape is flat, has at least one corner edge, and has a first side and a second side, and wherein said second side of said flat clip portion is in full contact with and attached to at one of said first side or said second side of said cape.

14. The cape of claim 13 wherein said clip is present at one corner edge thereof.

15. A cape comprising the clip as described in claim 4, wherein said cape is flat, has at least one corner edge, and has a first side and a second side, and wherein said second side of said flat clip portion is in full contact with and attached to at one of said first side or said second side of said cape.

16. The cape of claim 15 wherein said clip is present at one corner edge thereof.

17. A cape comprising the clip as described in claim 5, wherein said cape is flat, has at least one corner edge, and has a first side and a second side, and wherein said second side of said flat clip portion is in full contact with and attached to at one of said first side or said second side of said cape.

18. The cape of claim 17 wherein said clip is present at one corner edge thereof.

19. A cape comprising the clip as described in claim 6, wherein said cape is flat, has at least one corner edge, and has a first side and a second side, and wherein said second side of said flat clip portion is in full contact with and attached to at one of said first side or said second side of said cape.

20. The cape of claim 19 wherein said clip is present at one corner edge thereof.

* * * * *